US005377830A

United States Patent [19]

Jeannet et al.

[11] Patent Number: 5,377,830

[45] Date of Patent: Jan. 3, 1995

[54] BRUSHEAD MAGAZINE FOR TOOTHBRUSHES

[75] Inventors: Roland Jeannet, Duesseldorf, Germany; Robert Leutwyler, Boppelsen; Werner Leutwyler, Zurich, both of Switzerland

[73] Assignee: Johnson & Johnson Consumer Products, Inc., Skillman, N.J.

[21] Appl. No.: 192,754

[22] Filed: Feb. 7, 1994

Related U.S. Application Data

[63] Continuation of Ser. No. 13,274, Feb. 4, 1993, abandoned.

[30] Foreign Application Priority Data

Feb. 19, 1992 [DE] Germany ..... 4205028

[51] Int. Cl.[6] ..... B65D 85/00

[52] U.S. Cl. ..... 206/362.1; 53/492

[58] Field of Search ..... 206/15.2, 15.3, 209.1, 206/361, 362, 362.1–362.4, 63.5; 211/65, 87; 312/206; 53/492

[56] References Cited

U.S. PATENT DOCUMENTS

| | | | |
|---|---|---|---|
| 741,321 | 10/1903 | Flower | 206/362.3 |
| 2,471,979 | 5/1949 | Rozzi et al. | 206/362.1 |
| 2,655,968 | 10/1953 | Simmons | 312/206 |
| 2,910,172 | 10/1959 | Peaslee | 206/362.3 |
| 2,950,946 | 8/1960 | Starworth | 206/362.3 |
| 4,198,171 | 4/1980 | Lampka et al. | 206/362.2 |
| 4,811,445 | 3/1989 | Lagieski et al. | 15/104.94 |
| 4,890,732 | 1/1990 | Shackelford | 206/362.1 |
| 4,995,509 | 2/1991 | Kornfeind | 206/362.3 |
| 5,033,617 | 7/1991 | Hartwein et al. | 206/362.1 |

FOREIGN PATENT DOCUMENTS

| | | |
|---|---|---|
| 2636217 | 9/1988 | France . |
| 2067894A | 12/1980 | United Kingdom . |
| 0326363 | 1/1989 | WIPO . |

*Primary Examiner*—Jimmy G. Foster

[57] ABSTRACT

Brushhead magazine for receiving a number of brushheads (22), comprising a plurality of containers, which lie parallel alongside one another in mutual separation, in each case fully enclose a brushhead (22) and the height of which is dimensioned to correspond approximately to the width of a brush base (26) of each brushhead (22), a coupling end of the brushheads (22) in each case facing towards the container opening (30). A wall exhibits, in the area of each container opening (30), a closing flap (32) made from dimensionally stable material, which closing flap is defined by a target rupture line (36) and a hinge (40), formed by an attenuation line (38). The closing flap (32), as its target rupture line (36) is destroyed, can be pivoted by means of the coupling end of a brush handle about the hinge (40) into an open position in the interior of the assigned container. In each container there is disposed a locking device, by means of which the closing flap (32) can be locked in its open position. The magazine offers an aesthetically appealing appearance, even once the closing flaps (32) are opened, and is economical to produce and convenient to handle.

17 Claims, 10 Drawing Sheets

BRUSHEAD MAGAZINE FOR TOOTHBRUSHES

This is a continuation, of application Ser. No. 08/013,274, filed Feb. 4, 1993, now abandoned, which hereby incorporates all such matter set forth in all patent applications by reference.

The invention relates to a brushhead magazine for receiving a number of brushheads, comprising a plurality of containers, which lie parallel alongside one another in mutual separation, in each case fully enclose a brushhead and the height of which is dimensioned to correspond approximately to the width of a brush base of each brushhead, a coupling end of the brushheads in each case facing towards the container opening, which is closed by a wall of packing material which can be opened by a thrust movement of the coupling end of a brush handle for attaching the brushhead to the brush handle.

A magazine of this type is known from EP 0 326 363 A1. It comprises a series of interconnected, simple plastic containers for, in each case, one brushhead. The opening of each container is closed off by a plastic film. The plastic film exhibits two intersecting target rupture lines, which tear open when the plastic film is destroyed by the coupling end of the brush handle. Following the subsequent coupling of the brush handle to the brushhead, the complete toothbrush is pulled out of the container and is available for cleaning the teeth. Following the removal of a brushhead from the brush magazine, the irregular borders of the pierced sealing film make an unattractive sight. This appearance given by opened containers of the magazine is a considerable obstacle to the acceptability of a brushhead magazine of this type, especially since such brushhead magazines generally are or should be fitted, in conjunction with the toothbrush which is to be used several times a day, at an easily visible location.

The object of the invention is to design the brushhead magazine of the known type stated in the introduction, such that it is convenient to use, can be economically produced and, even during use, i.e. when some of the brushheads have already been removed, makes an aesthetically pleasing impression which enhances the acceptability of the brushhead magazine.

This object is achieved according to the invention by the fact that the wall exhibits, in the area of each container opening, a closing flap made from essentially dimensionally stable material, which closing flap is defined by a target rupture line and a hinge, formed by an attenuation line, in the dimensionally stable material, that the closing flap, as its target rupture line is destroyed, can be pivoted by means of the coupling end of the brush handle about the hinge into an open position in the interior of the assigned container, and that in each container there is disposed a locking device, by means of which the closing flap can be locked in its open position.

The effect of this is that each closing flap, following the opening of an associated container, is secured in a clearly defined open position, so that all opened containers of the brushhead magazine, after a brushhead has been removed, make the same aesthetically pleasing, clean and tidy impression.

The locking device can comprise a latch boss, which projects into the swivel area of the closing flap in such a way that the closing flap, when subjected to pressure, is able, in undergoing elastic deformation, to under-grip the latch boss in a latching engagement. Expediently, each latch boss is disposed above the associated container base at a height which is dimensioned to correspond approximately to the width of the longitudinal border, jutting laterally over the bristle zone of the brushhead, of the brush base. In order to ensure satisfactory positioning and guidance of the brushhead as it is removed from a container of the magazine, it is advisable also to dispose on the top side of each container a second guide rib, which projects downwards in a common vertical plane at a height which is also dimensioned to correspond approximately to the width of the longitudinal border, jutting laterally over the bristle zone, of the brush base. Since the brush neck connecting the brushhead to the brush handle exhibits a cross-section which, in the direction of the plane of the brush base of the brushhead, is dimensioned smaller than the width of the brush base, the effect, by virtue of the projecting shape of the brushhead magazine according to the invention, is that the closing flap pushed open by means of the brush handle, following the coupling of the brush handle to the brushhead and upon the latter's removal through the longitudinal border, sliding along the container base, of the brush base, undergrips the latch boss in a latching engagement, in undergoing elastic deformation, and is thereby locked in its open position. Although a closing flap, after it has been pushed open, can be forced by means of the brush handle into the locked engagement position of the latch boss before the brush handle is firmly connected to the brushhead in the container in question by creation of the coupling connection between the two parts, it is clear that the locking of the closing flap according to the invention ensures the automatic locking of the closing flap whenever a brushhead coupled to a brush handle is removed.

Advantageously, the containers for the brushheads are a uniform component part of a plastic cassette which can be manufactured by the injection moulding process. The cassette can contain, for example, two containers, the height of which corresponds approximately to the width of a brushhead base and which exhibit a rectangular profile and are in each case separated from one other by an interspace. In order to facilitate the removal of the brushheads, the removal openings of the containers are disposed at a distance above the magazine base, the containers extending obliquely backwards and downwards in the direction of the magazine base. Preferably, a rear end section of the container bases extends parallel to the magazine base. The magazine base itself preferably comprises the section of a dimensionally stable cardboard box, exhibiting a certain elasticity, onto which the magazine is stuck by its underside. Moreover, a further section of the cardboard box is wrapped around the lower edge of the front side of the cassette on the cassette's front side and stuck to the front borders of the container openings. A fold in the cardboard box jutting over the top side is inserted into a transverse joint provided on the top side, the depth of which joint corresponds to the thickness of the cardboard box, and is stuck in place there, so that this fold lies flush with the top side of the cassette. A further fold is folded from the front wall over onto a side wall of the cassette and is fastened in place there.

The invention further relates to a process for opening a container, containing a brushhead for a toothbrush, of a brushhead magazine, by means of a toothbrush handle which can be coupled to the brushhead, a wall covering the opening of each brushhead container being able to be penetrated by the front coupling end of the brush handle, which coupling end is dimensioned in cross-section smaller than the width of the brush base, and the toothbrush being able to be completed by the interlocking of the coupling ends of the brush handle and of the brushhead, and the brushhead being able to be removed from the container. The invention improves upon this process by virtue of the fact that a closing flap covering each container opening and made from relatively inflexible material, which closing flap is defined by target rupture lines and a hinge formed by an attenuation line, is pivoted, as the target rupture line is destroyed, by means of the front coupling end of the brush handle about the hinge in the direction of a stop boss and latch boss in the interior of the container and the coupling end of the brush handle is coupled to the corresponding coupling end of the brushhead, the brushhead, when pulled out of the container by means of the brush handle, strikes, with a surface extending from the brush neck into the longitudinal edge of the brush base, against the free edge of the closing flap situated above the latch boss and forces the closing flap, by virtue of latching action and bending-elastic deformation, under the latch boss, in order for the closing flap to be locked by means of the latch boss in its open position.

The invention is described in greater detail below with reference to the diagrammatic drawings of an illustrative embodiment, in which.

In FIGS. 1 to 5, a brushhead magazine 20 is shown, which is composed of a cassette 70 and a cardboard section 62 made from essentially dimensionally stable material 34. The cassette 70 can be seen in more detail in FIGS. 6 to 9 and the cardboard section 62 in FIG. 10.

Figure 1:
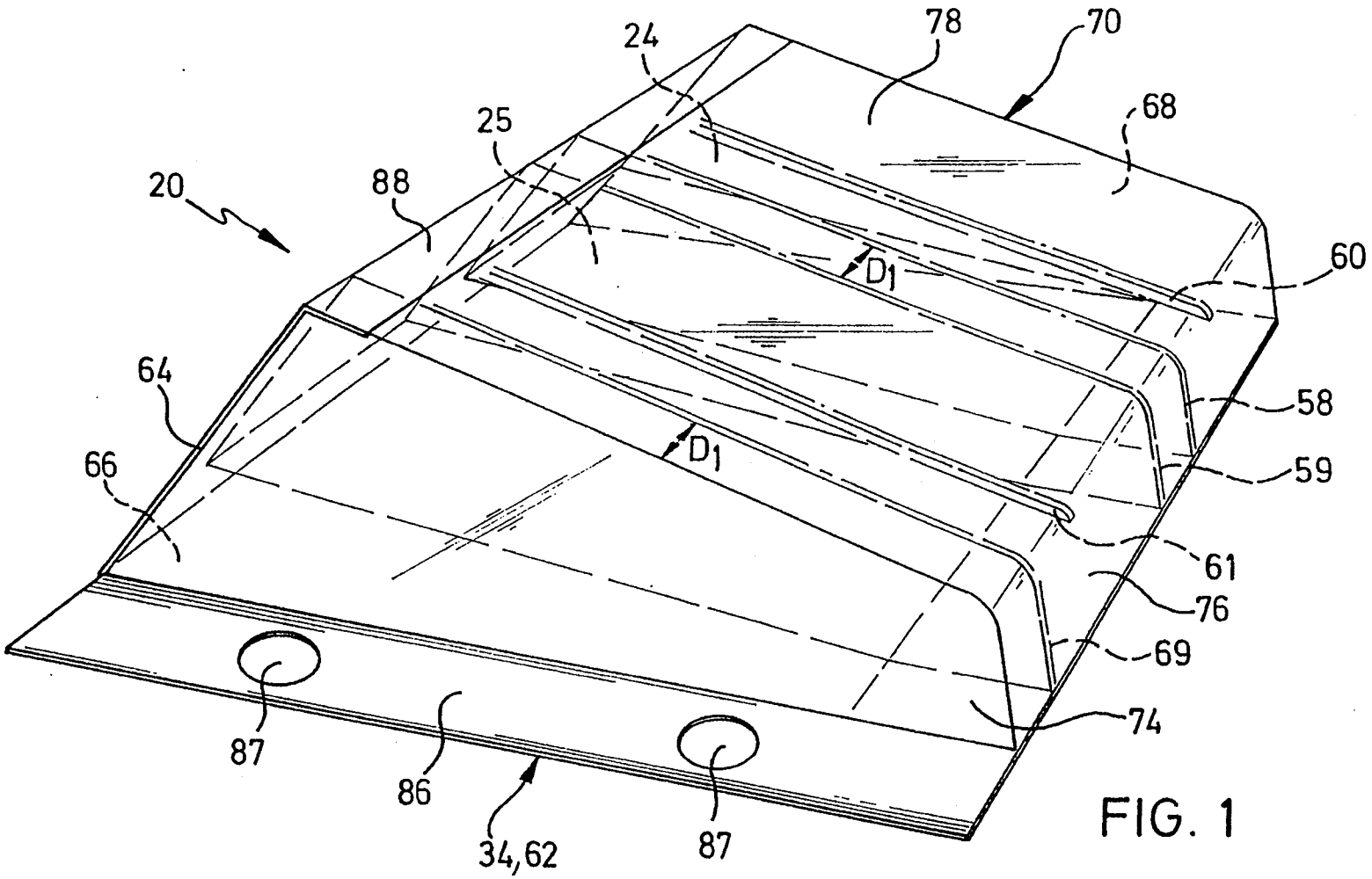
FIG. 1 shows a brushhead magazine in perspective view, having a fastening tab projecting over a side wall.

The cassette 70 consists of transparent plastic and is configured uniformly by the injection moulding process with two containers 24, 25 for holding one (non-represented) brushhead each. The containers 24, 25 are interconnected by a cover wall 78 of the cassette 70, which accordingly forms the top side of the brushhead magazine 20. The cover wall 78 also forms the top side of the containers 24, 25 and slopes down obliquely to the rear; it merges via a curved edge into a vertical rear wall 76. In FIG. 1, an upper guide rib 60 in the container 24 and a guide rib 61 in the container 25 can also respectively be seen, to which ribs reference is made below. It can further be seen that two neighbouring side walls 58, 59 of the containers 24, 25 are disposed at a distance $D_1$ parallel to each other. A side wall 68 of the cassette 70 is simultaneously the outer side wall of the container 24 and of the brushhead magazine 20. A side wall 74, facing the side wall 68, of the cassette 70 is also, by contrast, disposed at the same distance $D_1$ from a neighbouring side wall 69 of the container 25. The cardboard section 62 (FIG. 10) forming a base 66 of the brushhead magazine 20 projects beyond the side wall 74 and forms a fastening tab 86, in which fastening holes 87 are provided. By means of this fastening tab 86, the brushhead magazine 20 can be detachably fastened to a wall or to a holder (not represented) provided for one or more toothbrushes. In addition, the magazine base 66 can also be provided with a layer of bonding adhesive (not shown), which is provided with a tear-off protective layer, so that the brushhead magazine 20 can also be fitted by adhesion directly to a wall. A fold 88 in the cardboard section 62 is folded over onto the cover wall 78 of a front wall 64.

Figure 2:
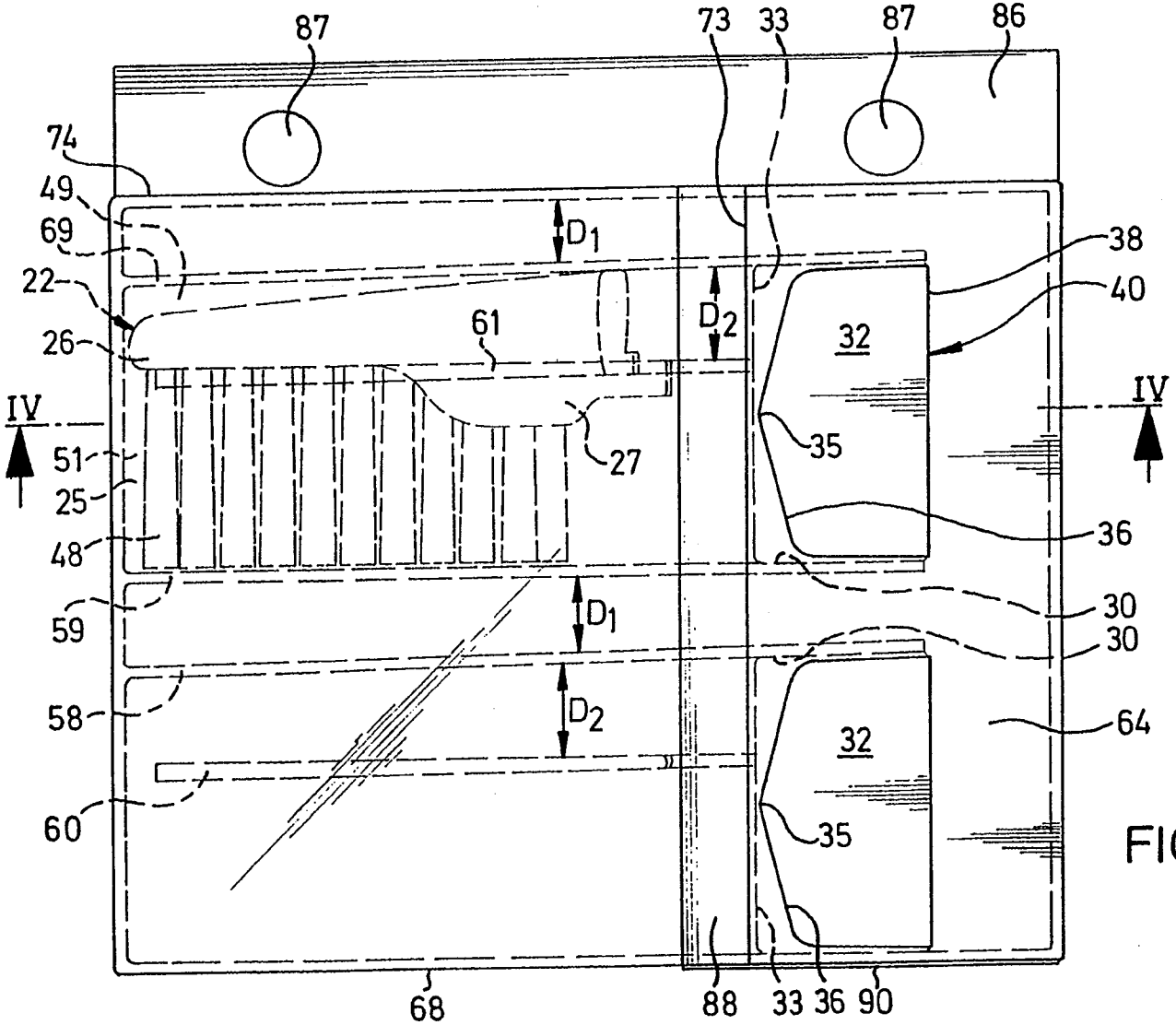
FIG. 2 shows a top view of the brushhead magazine, a container of the said magazine containing a brushhead.
Figure 3:
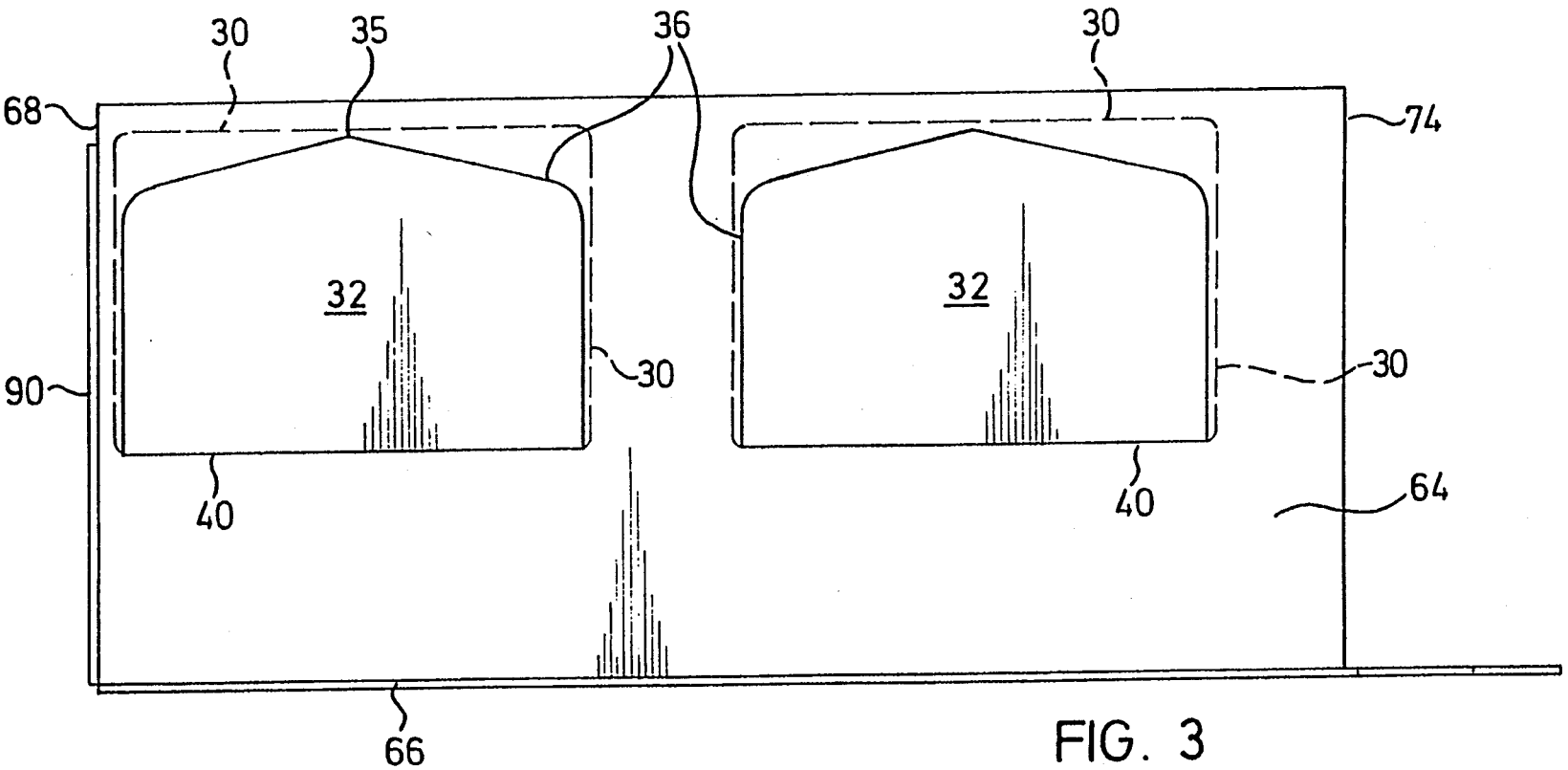
FIG. 3 shows a view of the front side of the magazine according to arrow A in FIG. 4.

FIG. 2 provides a better view of the front wall 64 of the magazine 20, which wall contains a closing flap 32 in the area of each container opening 30. Each closing flap 32 is defined by a target rupture line 36 and an attenuation line 38 forming a hinge 40. The top side of the target rupture line 36 of each closing flap 32 forms, in the centre, an obtuse angle with a vertex 35. It can additionally be seen from FIGS. 2 to 4 and 10 that a lateral fold 90 in the cardboard section 62 is stuck onto the side wall 68 of the cassette 70 facing away from the fastening tab 86.

FIGS. 2 to 5 further show that the front wall 64 forms, with the magazine base 66, an acute angle $\alpha$ opening onto the rear wall 76. The container openings 30 are disposed at a distance above the magazine base 66. The hinges 40 of the closing flaps 32 run parallel to the lower front edge 67 or to a top edge 73 of the front wall 64. The top edge 73 of the front wall 64 simultaneously forms a folding edge of the cardboard section 62 for the fold 88, which is fastened by sticking in a transverse joint 82 of the cover wall 78 and lies flush with the surface of the cover wall 78.

Figure 4:
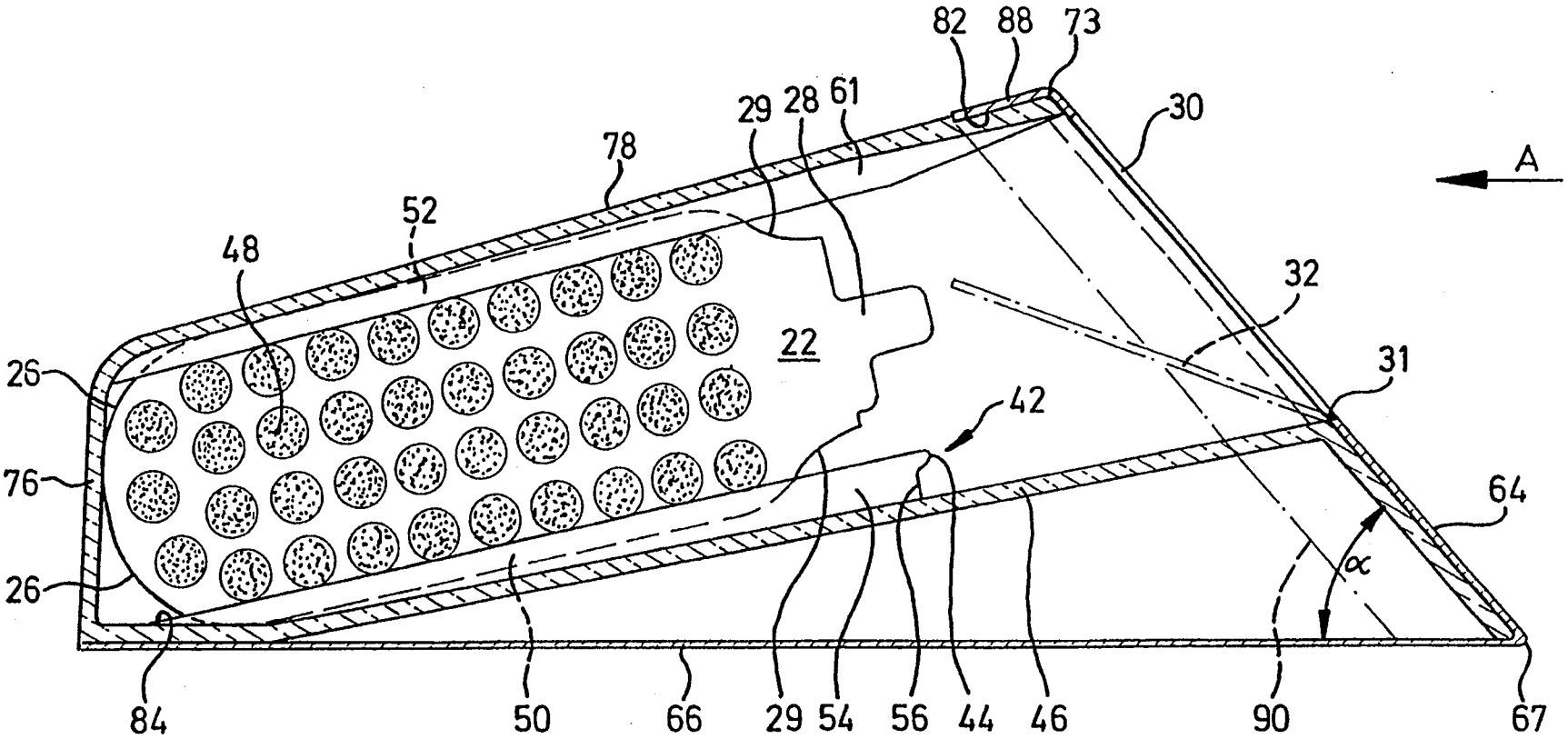
FIG. 4 shows a longitudinal section through the container in FIG. 2 containing the brushhead, according to the line of intersection IV—IV, a closing flap being shown in a half-opened state.

As can further be seen from FIG. 4, bases 46 of the containers 24, 25 run approximately parallel to the cover wall 78 and extend from a lower border 31 of the container openings 30 obliquely downwards towards the rear wall 76, an end section 84 of the container bases 46 running parallel to the magazine base 66 and acting as a gluing surface for the latter. The horizontal end section 84 forms an approximate right angle with the rear wall 78.

Figure 5:
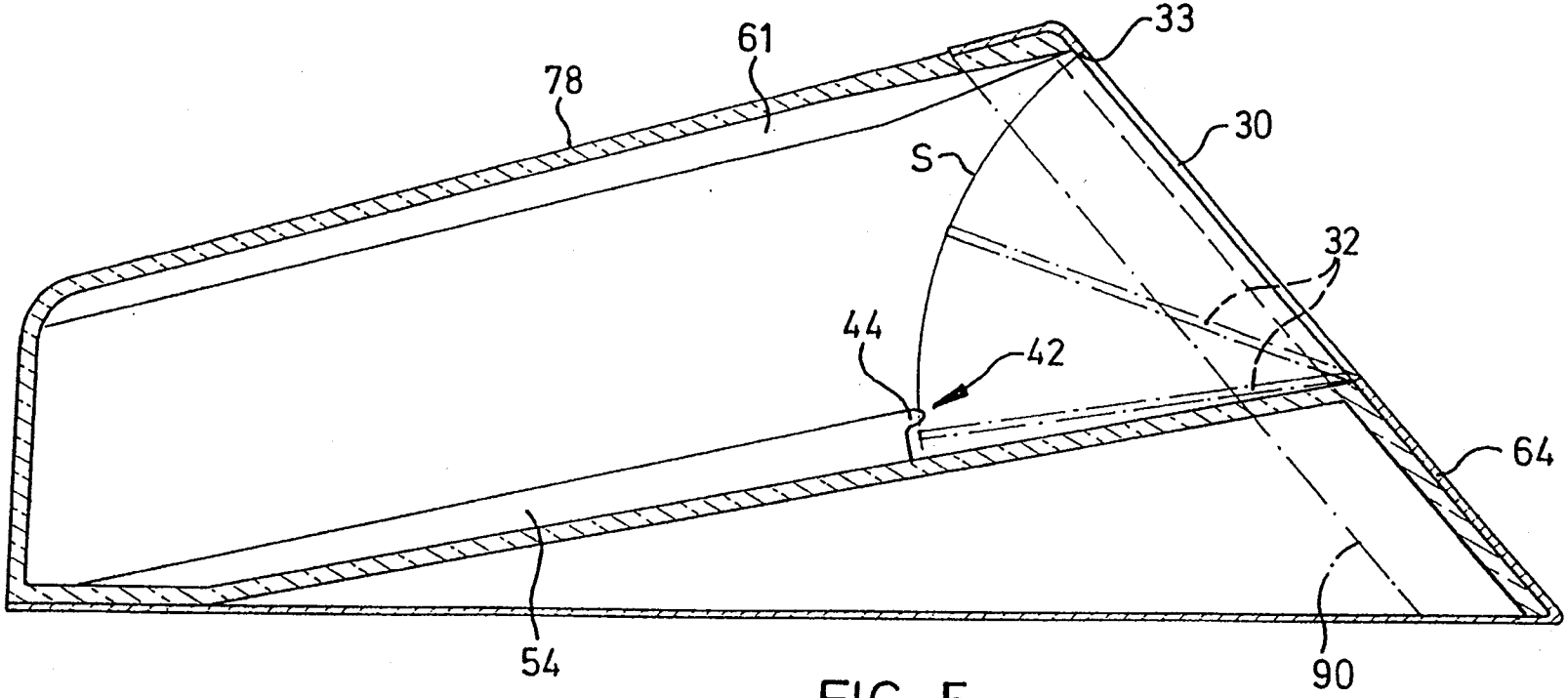
FIG. 5 shows a section as in FIG. 4, the closing flap also being shown in the locking position.
Figure 8:
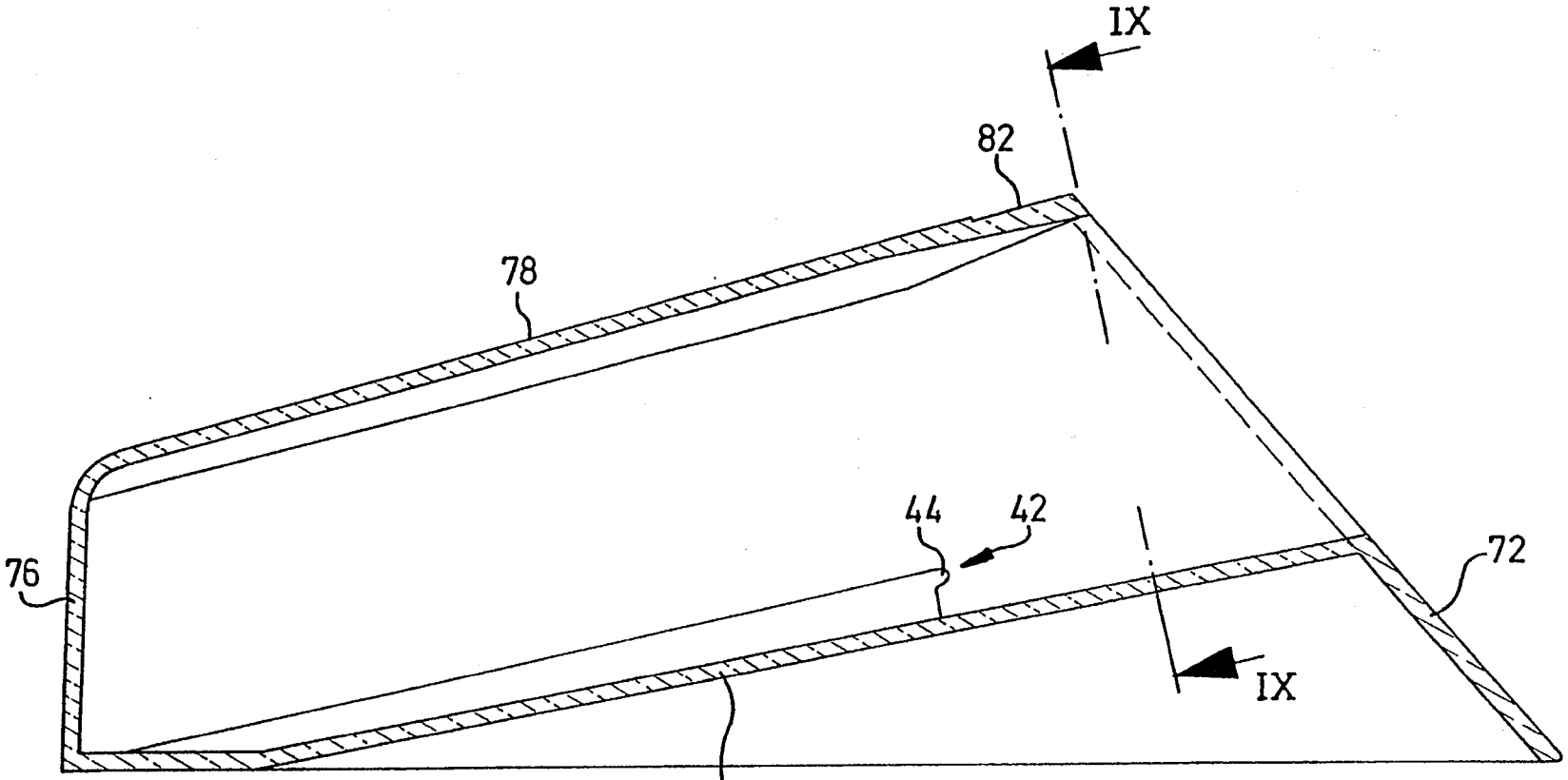
FIG. 8 shows a longitudinal section of the cassette according to the line VIII—VIII in FIG. 7.

In FIGS. 4, 5 and 8, a locking device 42 for the automatic locking of the closing flap 32 of each container 24, 25 is illustrated in the open position shown in FIG. 5. In the embodiment represented, the locking device 42 comprises a latch boss 44. This latch boss 44 projects forwards from the upper end of a front face 56 of a first guide rib 54. The latch boss 44, as shown by FIG. 5, protrudes with its tip into the swivel area S of the free upper outer edge of the associated closing flap 32. The height of the latch boss 44 above the container base 46 is greater than the wall thickness of the closing flap 32. The guide rib 54 extends with its top edge parallel above the container base 46 at a height which corresponds approximately to the width of a longitudinal border 50 of a brush base 26, by which measurement this longitudinal border 50 juts laterally over a bristle zone 48 of the brushhead base 26 (FIG. 4).

On the underside of the cover wall 78, there is disposed, in the same vertical plane of the lower guide rib 54, the second guide rib 61, which gradually rises from an upper border 33 of each container opening 30 up to a height which similarly corresponds to the height of the other longitudinal border 52, jutting laterally over the bristle zone 48, of the brush base 26 of the brushhead 22. FIG. 2 shows that the distance $D_2$ between the guide ribs 54 and 61 running parallel to the side wall 69 of the container 25 (FIGS. 4 and 9) is dimensioned somewhat larger than the largest thickness of the brush base 26. Consequently, the two guide ribs 54, 61 form, with the nearest side wall 69 of the container, a guide channel 49 for the brush base 26 and hence for the brushhead 22, which protrudes with its bristle zone 48 through the interspace between the two guide ribs 54, 61 into the larger spatial part 51 of the container 25, bounded by the said guide ribs and the side wall 59. At the same time, it can be seen that the brush base 26 reaches with a bulbous projection 27 through the interspace between the guide ribs 54, 61.

In a manner which is known per se, the brushhead 22 is configured at its end facing the container opening 30 as a coupling end 28, which can be coupled to a correspondingly formed coupling end of a toothbrush handle (not represented) to produce a ready-to-use toothbrush in a manner as described in detail in the patent specification mentioned in the introduction. In the present case, the special design of the coupling is not important in this regard. The only crucial factor is that a tension-resistant and pressure-resistant connection between the brushhead and the brush handle can be created by inserting the coupling end of the brush handle into the coupling end of the brushhead 22, so that the brushhead can be removed from the brushhead magazine by the coupling to the brush handle and the ready-assembled toothbrush is available for use.

This is realised according to the invention by the fact that the coupling end of the handle of the toothbrush is forced or pushed against a closing flap 32 closing off the associated container, so that the essentially dimensionally stable closing flap 32 made from the cardboard material 62 is swivelled inwards into the container as the target rupture line 36 extending up to the hinge 40 is destroyed.

The coupling end of the handle is then inserted into the coupling end 28 of the brushhead 22 or connected thereto in some other way to form a complete toothbrush and subsequently removed from the associated container. Due to the natural elasticity of the relatively dimensionally stable cardboard material 62, the closing flap 32, when pushed open and swivelled inwards about its hinge 40, would spring back into some irregular open position, as indicated, for example, by the dot-dash line in FIG. 4. Although it would be possible, by subjecting it to appropriate pressure, to force the closing flap 32 into the locked open position, shown in FIG. 5, under the latch boss 44, this will presumably not normally be done by the user due to the time delay and intricacy associated therewith. Consequently, the irregular position of the closing flaps 32 in the opened state will offer a less appealing sight. The invention overcomes this drawback by virtue of the fact that, following coupling of the coupling end of the toothbrush handle to the coupling end 28 of the brushhead 22 situated in the container 24, 25 of the brush magazine 20, the closing flap 32, as the brushhead 22 is pulled out, is automatically forced by the lower longitudinal border 50 of the brush base 26 under the latch boss 44 into the fully open position and is locked by the latch boss 44 in this open position. This is possible because, conventionally, the toothbrush neck exhibits a cross-section which is dimensioned smaller than the width of the brush base 26. In order to prevent injuries when the teeth are cleaned, a gradual transition from the toothbrush neck to the full width of the brush base 26 is always however provided, as shown by the arc-shaped sections 29 in FIG. 4. Consequently, the lower arc-shaped section 29 offers a sloping surface which causes the free edge of the closing flap 32, in undergoing slight elastic deformation, to engage across over and under the latch boss 44. In this way, automatic locking in the constantly identical open position is guaranteed in respect of each closing flap 32 of each container of the brushhead magazine 20, so that the magazine, even in a state in which one or more or even all containers are opened, nevertheless makes a respectable, orderly impression which substantially enhances the acceptability of a brushhead magazine of this type amongst consumers.

Figure 6:
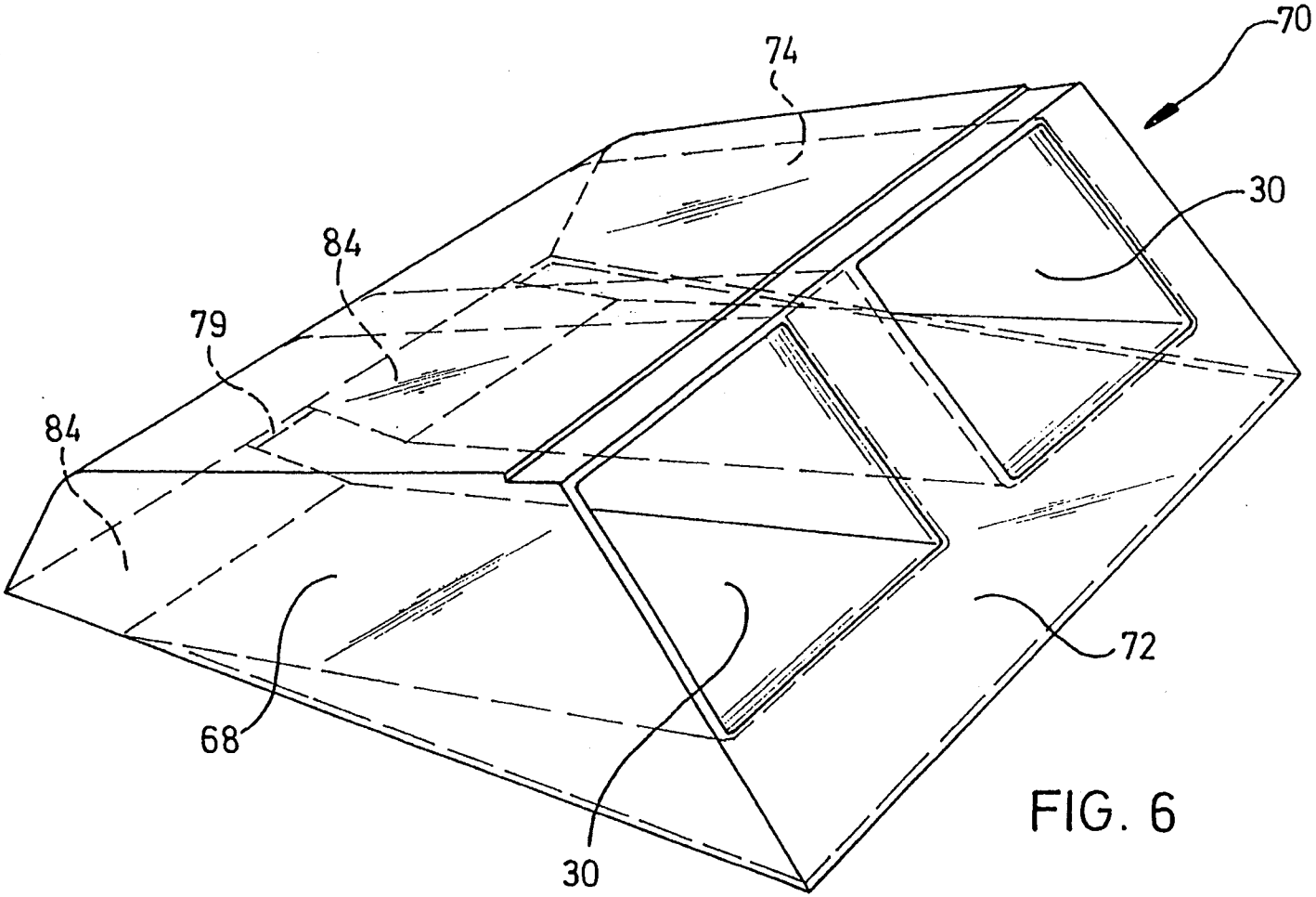
FIG. 6 shows a cassette constituting the basic component part of the brushhead magazine, in a perspective view from the front top left.

The cassette 70 is represented in more detail in FIGS. 6 to 9. FIG. 6 shows that a front wall 72 surrounds the container openings 30 and forms a gluing surface 77 for the front wall 64, containing the closing flaps 32, of the cardboard section 62. At the same time, it can be seen that the cassette 70 is open on the underside. As a result, the magazine base 66 of the cardboard section 62 is connected by sticking only to the lower longitudinal edges of the front wall 72 and side walls 68, 74, to a small section 79 of the rear wall 76 (FIG. 9) and to the end sections 84 of the container bases 46.

Figure 7:
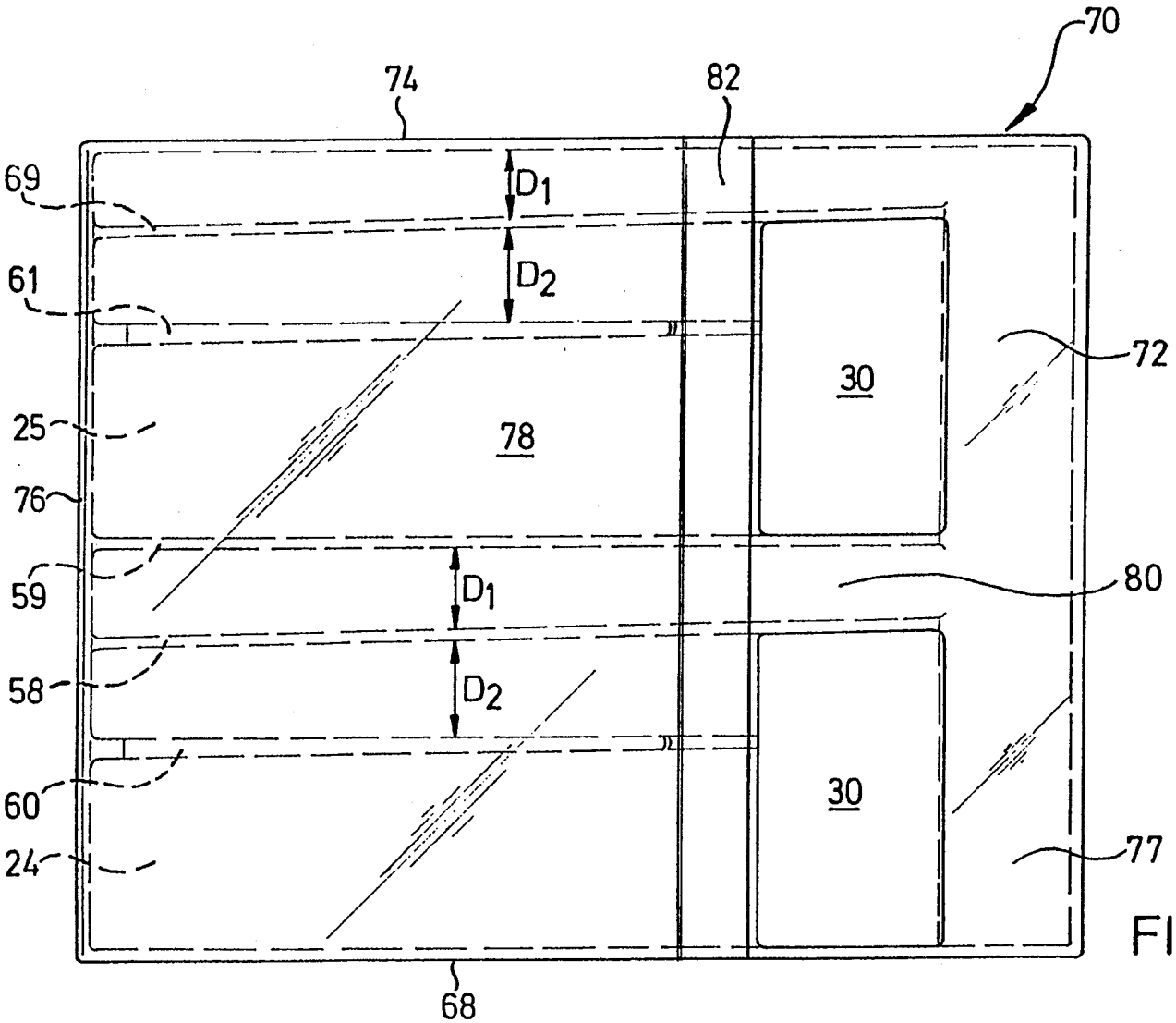
FIG. 7 shows a top view of the cassette in FIG. 6.
Figure 9:
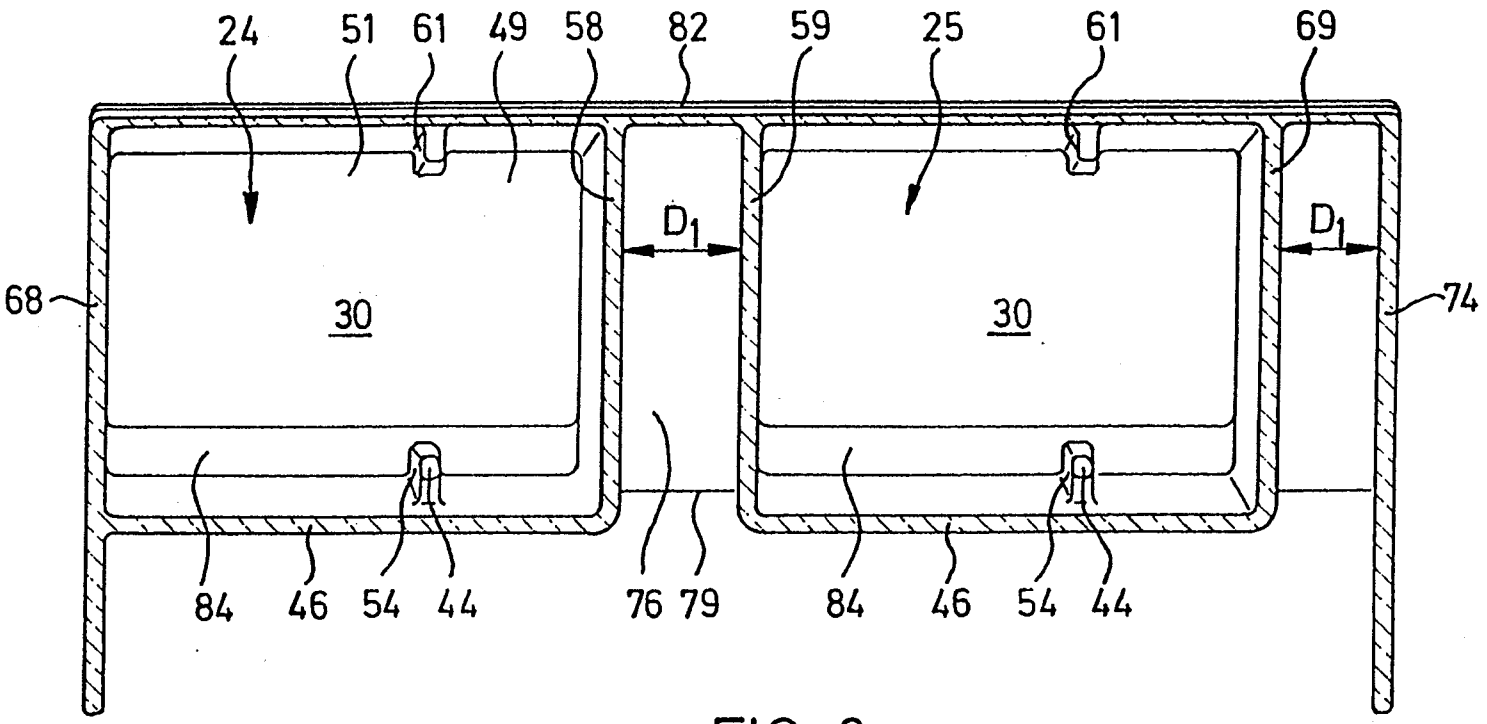
FIG. 9 shows a cross-section of the cassette according to the line of intersection IX—IX in FIG. 8.

In addition, the rectangular cross-section of the containers 24, 25, including their openings, can be seen from FIGS. 6, 7 and 9. It is further apparent that the distance $D_1$ between the cassette side wall 74 and the container side wall 69, in the event of the brushhead magazine 20 being attached to a holder on a wall, makes the container 25 much more conveniently accessible to the user. In a similar manner, this also applies to the distance $D_1$ between the container walls 58, 59, running at a distance parallel to each other, of the two containers 24, 25. In this way, an additional gluing surface 80 for the front wall 64 is also created, out of the cardboard section 62, between the two container openings 30. Although the cassette 70 is thus open in the downward direction, it exhibits, due to the continuous cover wall 78, the rear wall 76, the two side walls 68, 74 and the front wall 72, high bending resistance and impact strength.

Figure 10:
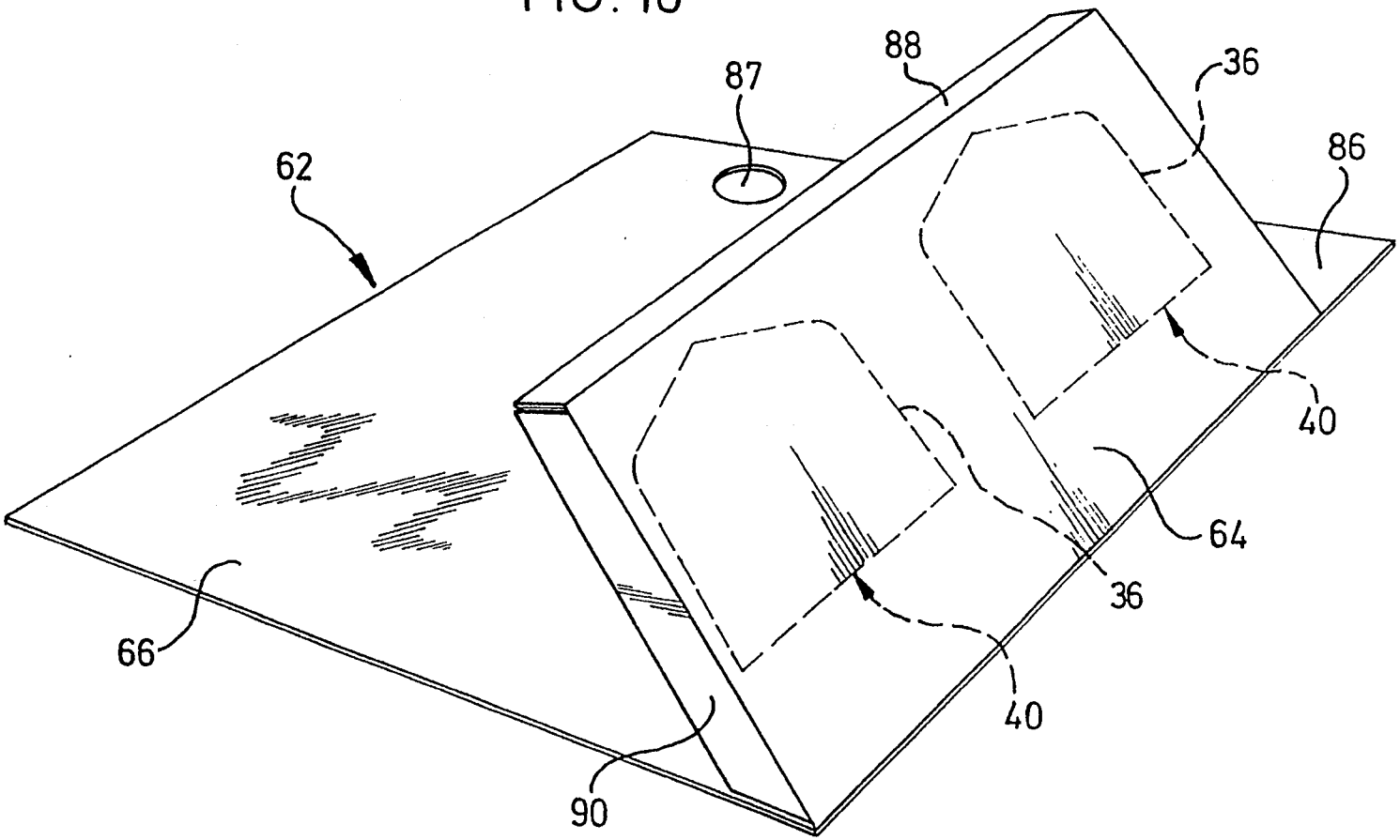
FIG. 10 shows, in perspective representation, a cardboard section, which essentially forms the front wall and the base of the magazine.

It is apparent from the cardboard section 62 shown in FIG. 10 that this can be punched, simultaneously with the target rupture lines 36 and the attenuation line 38 for the hinges 40 and the fastening holes 87 and the slots for the folds 88 and 90, out of a single longitudinal section of an essentially dimensionally stable material 34. Consequently, it is possible to manufacture the cardboard section 62 by a continuous process and to stick the open underside of the cassette 70 firmly to the magazine base 66 and the front wall 72 firmly to the magazine front wall 64, the folds 88 and 90 being able, at the same time, to be folded over into the transverse joint 82 or against the side wall 68 and to be similarly stuck to these.

| Reference symbol list | |
|---|---|
| 20 | brushhead magazine |
| 22 | brushhead |
| 24, 25 | container |
| 26 | brush base |
| 27 | bulbous projection |
| 28 | coupling end (brushhead) |
| 29 | arc-shaped sections |
| 30 | container opening |
| 31 | lower border (container opening) |
| 32 | closing flap |
| 33 | upper opening border |
| 34 | dimensionally stable material |
| 35 | vertex |
| 36 | target rupture line |
| 38 | attenuation line |
| 40 | hinge |
| 42 | locking device |
| 44 | latch boss |
| 46 | container base |
| 48 | bristle zone |
| 49 | guide channel |
| 50, 52 | laterally protruding longitudinal border |
| 51 | larger spatial part |
| 54 | first guide rib |
| 56 | front face end (guide rib) |
| 58, 59 | side wall |
| 60, 61 | second guide rib |
| 62 | cardboard section |
| 64 | front border (magazine) |
| 66 | base (magazine) |
| 67 | lower front edge |
| 68 | side wall |
| 69 | side wall |
| 70 | cassette |
| 72 | front wall |
| 73 | top edge of the cassette of the magazine |
| 74 | side wall |
| 76 | rear wall |
| 77 | gluing surface |
| 78 | cover wall |
| 79 | section |
| 80 | gluing surface |
| 82 | transverse joint |
| 84 | end section (container base) |
| 86 | fastening tab |
| 87 | fastening holes |
| 88 | fold |
| 90 | fold |

We claim:

1. Brushhead magazine for receiving a number of brushheads, comprising a plurality of containers which lie parallel alongside one another in mutual separation, said containers having side walls, in each of which containers is fully enclosed a brushhead and the height of which is dimensioned to correspond approximately to the width of a brush base of each brushhead, each container having a top side, a container opening, said brush base having a longitudinal border, said brushhead having a bristle zone, a coupling end of the brushheads in each case facing towards the container opening, which is closed by a wall of packing material which can be opened by a thrust movement of the coupling end of a brush handle for attaching the brushhead to the brush handle, characterized in that the wall exhibits, in the area of each container opening, a closing flap made from essentially dimensionally stable material, which closing flap is defined by a target rupture line and a hinge, formed by an attenuation line in the dimensionally stable material, in that the closing flap, at its target rupture line is destroyed, can be pivoted by means of the coupling end of the brush handle about the hinge into an open position in the interior of the container, and in that in each container there is disposed a locking device, by means of which the closing flap can be locked in its open position.

2. Magazine according to claim 1, characterized in that the locking device comprises a latch boss, which projects into the area in which the closing flap pivots, said area being the swivel area.

3. Magazine according to claim 2, characterized in that the latch boss rises up from a base of each container at a height which is dimensioned to correspond approximately to the width of the longitudinal border of the brush base, jutting laterally over a bristle zone of the brushhead.

4. Magazine according to claim 3, wherein said containers have a first guide rib, said guide rib having a front face end, and wherein the latch boss is a component part of the front face end of a first guide rib for the brush base of a brushhead, which guide rib extends from each container base upwards parallel to the adjoining side wall of the container, said adjoining side wall having a longitudinal direction and a transverse direction in the longitudinal direction of the adjoining side wall at a distance, said guide rib being dimensioned somewhat larger than the thickness of the brush base.

5. Magazine according to claim 4, wherein the first guide rib projects vertically from the container base, forming a vertical plane projecting therefrom wherein in the plane of the first guide rib, a second guide rib projects downwards from the top side of each container at a height which is dimensioned to correspond approximately to the width of the longitudinal border of the brush base, jutting laterally over the bristle zone of a brushhead, of the brush base.

6. Magazine according to claim 1 characterized in that the opening of the containers is disposed at a distance above a base of the magazine, the containers extending obliquely down to their end and downwards in the direction of the magazine base.

7. Magazine according to claim 1 characterized in that an end section of the container bases is disposed parallel to the magazine base.

8. Magazine according to claim 1 wherein said magazine comprises a front wall and a base, further characterized in that the material exhibiting the closing flaps for the container openings comprises a cardboard section, which forms the front wall and the base of the magazine, said cardboard section having a top end and a fold.

9. Magazine according to claim 8 characterized in that the containers are a component part of a cassette which comprises a front wall enclosing the container openings said front wall further comprising a cover wall, a rear wall, two side walls, said walls merging into the rear wall, said magazine further comprising a magazine base.

10. Magazine according to claim 9 characterized in that the front wall of the cassette forms, an acute angle $\alpha$ with the magazine base, said angle $\alpha$ opening toward the cassette's rear wall, whilst the cover wall, starting from the top edge of the front wall, descends down to the rear wall, into which the cover wall merges in an arc formation.

11. Magazine according to claim 10, characterized in that said cover wall is continuous, said continuous cover wall, the side walls of each container and the rear wall of the cassette form an outer side of the magazine, the cover wall forming the top side of the containers disposed at a distance parallel to one another.

12. Magazine according to claim 10, characterized in that the cover wall of the cassette comprises in the area of the top edge of the front wall, a transverse joint, the depth of which corresponds approximately to the thickness of a fold in the cardboard section, which fold, at the top end of the cardboard section, is fastened in the transverse joint.

13. Magazine according to claim 7, characterized in that the cardboard section forming the base extends beyond a side wall of the cassette and forms a fastening tab.

14. Magazine according to claim 13, characterized in that the side wall of the cassette adjoining the fastening tab is disposed at a distance parallel to the side wall of the adjoining container, whilst the other side wall of the cassette also forms the side wall of the adjoining container.

15. Magazine according to claim 9 characterized in that the magazine front wall is provided on the side facing away from the fastening tab with a fold, which is fastened to the side wall of the cassette facing away from the fastening tab.

16. Magazine according to claim 9 characterized in that the cassette consists of plastic and is manufactured by the injection moulding process and is connected to the cardboard section, at reciprocal contact surfaces, by sticking.

17. Process for opening a container, containing a brushhead for a toothbrush, of a brushhead magazine according to claim 1, said process comprising interlocking the coupling ends of the brush handle and of the brushhead, pivoting said closing flap around a hinge in the direction of the locking device, said closing flap thereby being locked in its open position.

* * * * *